United States Patent [19]

Clement

[11] Patent Number: 4,855,707

[45] Date of Patent: Aug. 8, 1989

[54] ADJUSTABLE FOOT ACTIVATED CONTROL APPARATUS FOR POTENTIOMETER

[76] Inventor: David C. Clement, 368 Sterling Pl., Brooklyn, N.Y. 11238

[21] Appl. No.: 242,960

[22] Filed: Sep. 9, 1988

Related U.S. Application Data

[63] Continuation-in-part of Ser. No. 922,960, Oct. 24, 1986.

[51] Int. Cl.[4] ..... H01C 10/00

[52] U.S. Cl. ..... 338/153; 74/563; 74/529; 74/478; 74/512; 84/1.27; 338/69

[58] Field of Search ..... 338/153, 69; 84/1.27, 84/1.24; 74/563, 527, 98, 417, 478, 512

[56] References Cited

U.S. PATENT DOCUMENTS

| | | | |
|---|---|---|---|
| 2,688,262 | 9/1954 | Bolton | 74/562 X |
| 2,710,556 | 6/1955 | Koehl | 84/1.27 X |
| 2,937,542 | 5/1960 | Mastrandrea | 74/563 |

FOREIGN PATENT DOCUMENTS

| | | | |
|---|---|---|---|
| 2064752 | 7/1972 | Fed. Rep. of Germany | 74/563 |

*Primary Examiner*—C. L. Albritton

*Attorney, Agent, or Firm*—Anthony J. Casella; Gerald E. Hespos

[57] ABSTRACT

An adjustable control apparatus for a potentiometer is provided. The control apparatus comprises a geared sheath which is engageable with the potentiometer of an electronic apparatus. The geared sheath is provided with a response gear nonrotatably mountable thereto. The control apparatus further comprises a control platform having a drive gear rigidly connected thereto. The drive gear is engageable with the response gear of the geared sheath, such that pivoting movement of the drive gear causes a rotational movement of the geared sheath. A foot platform is adjustably but rigidly mounted to the control platform such that pivoting movement of the foot platform causes a corresponding pivoting movement of the control platform which is transmitted to the geared sheath through the drive and response gears.

13 Claims, 2 Drawing Sheets

ADJUSTABLE FOOT ACTIVATED CONTROL APPARATUS FOR POTENTIOMETER

This application is a continuation-in-part of U.S. patent application Ser. No. 922,960 which was filed on Oct. 24, 1986.

BACKGROUND OF THE INVENTION

Many musical instruments employ electronic devices to amplify, alter, augment or directly produce sound. The most common of these instruments include guitars where the sound produced by vibrating strings is amplified and/or altered by electronic equipment, and organs where the sound may be produced directly by the electronic equipment in response to signals generated by striking combinations of keys. The range of sounds that can be produced by electrical instruments can be altered by the musician. In particular, most electrical instruments include at least volume, bass, treble and loudness controls. Other instruments may include adjustments for creating varying degrees of reverberations.

The adjustments for most electric instruments are defined by arrays of rotatable potentiometers. In particular, each controllable feature typically will include a rotatable shaft extending from a housing, with a small knob removably mounted to the rotatable shaft. Manual rotation of the knob causes a corresponding rotation of the shaft to which the knob is mounted for adjusting the appropriate control (e.g. volume). The number and spacial arrangement of potentionmeters incorporated into the electronic control device may vary substantially from one manufacturer to another. For example, some electronic devices comprise three or four rotatable poteniometers disposed in a generally linear array, while others include potentiomenters disposed on a control panel in a non-linear array.

Virtually all control panels for electronic instruments are constructed for manual turning of the adjustable potentiometers to a selected orientation. However, a musician typically will be using both hands while playing the instrument. Thus, adjustments to the output sound while the instrument is being played generally cannot be made unless the musician is accompanied by a sound technician. The ability to retain a technician to make electronic adjustments during the course of a musical presentation is a luxury that generally only can be afforded by the few financially successful musicians. Additionally, this luxury removes the musician from the actual creative output of his or her efforts. In view of these drawbacks, most musicians avoid making electronic adjustments during the course of a performance, and tolerate a less than optimum accoustical output.

Many musical instruments, such as organs and pianos, include pedals permanently incorporated therein for altering the principal sound produced by the musician's fingers. Examples of prior art showing foot actuated adjustment means permanently incorporated into a musical instrument are shown in: U.S. Pat. No. 1,956,350 which issued to Hammond on Apr. 24, 1934; U.S. Pat. No. 2,710,556 which issued to Koehl on June 14, 1955; and U.S. Pat. No. 3,894,445 which issued to Rowe on July 15, 1975. Foot-operated pedals that are not specifically intended for musical instruments are shown in U.S. Pat. No. 806,708 which issued to Perry on Dec. 5, 1905 and U.S. Pat. No 2,688,262 which issued to Bolton on Sept. 7, 1954. The above identified prior art generally includes a foot-actuated pedal having a gear means attached thereto. The gear means attached to the pedal is rotatably engagable with a second gear means which changes the direction of rotation achieved by the movement of the pedal to carry out an appropriate adjustment on another member.

The above identified foot-actuated adjustment means can enable adjustment of certain instruments having such a foot-operated pedal permanently incorporated therein. However, the teaching of the prior art is of little benefit to the musician having an electronic instrument with an array of manually rotatable potentiometers disposed on a control panel. More particularly, the prior art provides no teaching that would enable the many musicians having electronic controls with manually rotatable potentiometers to employ the foot pedals to adjust rotatable potentiometers. Furthermore, even if the teaching in any prior art reference could be adapted to construct a foot-operated apparatus for rotating the potentiometer control of a musical instrument, the resulting structure undoubtedly would be limited to a particular musical control apparatus, and would not be universally applicable to the broad array of control equipment available for musical instruments.

In view of the above, it is an object of the subject invention to provide a foot-operated control for a potentiometer of a musical instrument.

It is another object of the subject invention to provide a foot-operated apparatus that can be mounted to any of a plurality of different rotatable potentiometers on musical instruments.

It is an additional object of the subject invention to provide a foot-operated apparatus for controlling a potentiometer that can readily be set to various adjustable maximum and minimum control positions.

Still a further object of the subject invention is to provide a foot-operated apparatus for adjusting a potentiometer, with said apparatus being mountable in any of a plurality of different orientations depending upon the spacial disposition of potentiometers on the musical instrument control panel.

Yet another object of the subject invention is to provide an adjustable control apparatus for a musical instrument that can be removably placed on a potentiometer shaft.

Another object of the subject invention is to provide a control apparatus that can be readily actuated by a foot, elbow, backhand or other such part of the body.

SUMMARY OF THE INVENTION

The subject invention is directed to a foot-operated control apparatus that can be removably mounted to the shaft of a potentiometer on any of a plurality of different electronic control devices used with musical instruments. The control apparatus of the subject invention can be mounted to any of a plurality of different starting and stopping positions to readily control maximum and minimum limits of adjustment, and to facilitate the rapid positively controllable movement of a potentiometer from an initial position to a subsequently established position. Additionally, the control apparatus of the subject invention can be mounted in any of a plurality of different orientations to facilitate the use of more than one such control apparatus on any of a plurality of different electronic control devices regardless of the orientation of potentiometers on the electric control device.

The control apparatus of the subject invention comprises a hollow sheath that can be telescopingly engaged over the shaft of a potentiometer. The interior surface of the sheath comprises means for nonrotatably engaging the shaft of the potentiometer such that the hollow sheath and the potentiometer shaft telecopingly mounted therein will rotate together. The nonrotatable engagement between the hollow sheath and the shaft of the potentiometer may be achieved by inwardly extending ribs on the inside of the sheath which engage corresponding outwardly extending ribs on the potentiometer shaft. Alternatively, the interior surface of the hollow sheath may comprise a resilient means which will frictionally engage the outer surface of the potentiometer shaft to prevent rotation therebetween. The interior surface of the hollow sheath may further be tapered to facilitate a nonrotational engagement of the shaft.

A response gear is rigidly and nonrotatably mounted to the hollow sheath. More particularly, the response gear is spaced from an opened end of the hollow sheath. The response gear may be of generally circular configuration with a plurality of radially outwardly extending gear teeth. Additionally, the gear may be beveled as explained in greater detail below. The response gear and the hollow sheath may be of unitary construction, and may be molded from a plastic material.

The apparatus further comprises a control platform having a drive gear nonrotatably extending therefrom. The drive gear of the control platform is engagable with the response gear of the sheath. Thus, rotation of the drive gear on the control platform may generate a corresponding rotation of the response gear mounted to the sheath, with still a further corresponding rotation of the sheath to which the response gear is mounted.

The control platform preferably is a substantially square, generally planar structure with the drive gear thereof having its rotatable axis disposed with or parallel to the plane of the control platform. The control platform and the drive gear may be of integral construction, and may be unitarily molded from a plastic material.

The control platform and the sheath comprise means for maintaining the rotational axis of the drive and response gears in a preestablished spacial and angular orientation to one another such that a pivotal movement of the control platform and the drive gear mounted thereto will generate corresponding rotation of the response gear and the sheath. The means for maintaining a selected orientation of the respective rotational axis of the drive and response gears may comprise at least one bracket mounted to the respective rotational axis, or alternatively may comprise a pivotal mounting of the sheath to a selected location on the control platform. Preferably, the rotational axes of the drive and response gears are aligned to one another substantially at right angles.

The apparatus of the subject invention further comprises a foot platform which is adjustably and removably mounted to the control platform. More particularly, the foot platform may comprise an elongated channel of generally C-shaped cross section that is slideably engagable over the control platform. As noted above, the control platform is preferably substantially square. As a result, the foot platform may be mounted to the control platform along either of the two identical central axes of the control platform. This enables the longitudinal axis of the foot platform to be placed in either of two orthogonally disposed angular positions relative to the rotational axis of the drive gear. Preferably, the longitudinal axis of the foot platform extends a substantially greater distance than either axis of the square control platform. Thus, the longitudinal position of the foot platform can be moved relative to the control platform.

The foot platform and the control platform preferably comprise means for releaseably holding the foot platform in a selected position relative to the control platform. For example, the foot platform may comprise a plurality of apertures or recesses extending into the longitudinal side edges thereof. The control platform may comprise resilient detents which are releaseably engagable with the apertures in the foot platform. As will be explained further below, the longidutinal position of the foot platform and control platform relative to one another as well as the angular orientation of the foot platform to the rotational axis of the drive gear can be altered depending upon the spacial arrangement of the potentiometers on the electronic control device, and also depending upon the desired ranges of movement for the potentiometer adjustments.

DETAILED DESCRIPTION OF THE PREFERRED EMBODIMENT

Figure 1:
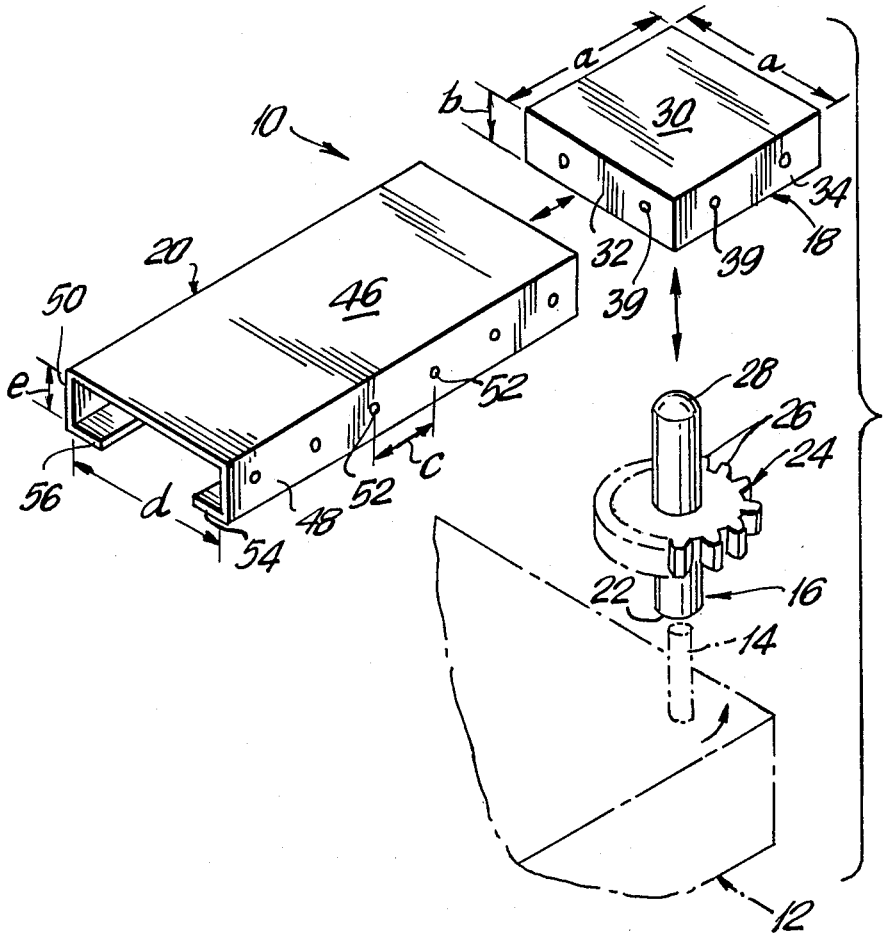
FIG. 1 is an exploded perspective view of the adjustable control apparatus of the subject invention.

The control apparatus of the subject invention is identified generally by the numeral 10 in FIG. 1. The control apparatus 10 is adapted for use with an electronic apparatus 12 having at least one rotatable potentiometer shaft 14. For example, the apparatus 12 may be the control for an amplifier used to amplify and augment the sound produced by an electric guitar. Typically, the electronic apparatus 12 will comprise a plurality of potentiometer shafts similar to shaft 14 disposed at spaced apart locations thereon, as explained in greater detail below. The rotation of shaft 14 may be operative to adjust the volume or tonal qualities of the instrument used with the apparatus 12.

The control apparatus 10 comprises a hollow geared sheath 16, a control platform 18 and a foot platform 20. The hollow geared sheath 16 includes an opened end 22 which is dimensioned to telescopingly engage the potentiometer shaft 14. More particularly, the telescoping engagement of the opened end 22 of the geared sheath 16 over the potentiometer shaft 14 achieves nonrotatable engagement therebetween. The particular construction of the inside of the geared sheath 16 can vary depending upon the external configuration of the potentiometer shaft 14. In the typical embodiment, the internal surface of the geared sheath 16 will be provided with an array of longitudinally extending ribs or resilient means for frictionally engaging the potentiometer shaft 14.

The geared sheath 16 further comprises a generally annular response gear 24 at a location thereon spaced from the opened end 22 thereof. The response gear 24 includes a generally radially aligned array of teeth 26 which may be beveled or otherwise configured to permit engagement with a drive gear as explained further below. The end 28 of the geared sheath 16 is constructed to achieve a predetermined alignment between the geared sheath 16 and the control platform 18. As depicted in FIG. 1, the end 28 of the geared sheath 16 is substantially spherical, and is dimensioned to rotatably engage a socket in the control platform 18 to permit the control platform 18 to rotate relative to the spherical end 28 of the geared sheath 16. The engagement of the gear 24 with a corresponding gear on the control platform 18, as explained further below, can be relied upon to limit the rotational movement of the control platform 18 about the end 28 of the geared sheath 16 to a single axis. Other connecting means between the geared sheath 16 and the control platform 18 are illustrated below for alternatively controlling alignment of the rotational axis of the control platform 18 relative to the axis of geared sheath 16.

The control platform 18 is a generally planar, substantially square structure having length and width dimensions "a" as illustrated in FIG. 1. In the typical embodiment, the dimension "a" will be between 0.5 inch and 1.5 inch. The control platform 18 has a height "b" which preferably is substantially less than its length or width "a".

The control platform 18 comprises sidewalls 32–38 as illustrated most clearly in FIGS. 1–4. The sidewalls 32–38 each are provided with detents identified generally by the numeral 39. The detents 39 are spaced from one another by dimension "c" are operative to enable releasable adjustable engagement of the control platform 18 with the foot platform 20 as explained further below.

As shown more clearly in FIGS. 2–5, the control platform 18 comprises a drive gear 40 extending from the bottom surface 42 thereof. The drive gear 40 comprises an array of generally radially aligned gear teeth 44 which are engagable with the gear teeth 26 on the response gear 24 of sheath 16.

The foot platform 20 defines an elongated generally rectangular channel having a top wall 46 which defines the surface of the control apparatus 10 to be actuated by the foot of the musician. The foot platform 20 further comprises a pair of generally parallel sidewalls 48 and 50 which are spaced from one another by dimension "d" which is equal to, or slightly greater than, the length or width "a" of the control platform 18. The sidewalls 48 and 50 are characterized by apertures 52 which are spaced from one another by dimension "c" which is equal to the distance between the detents 39 on the control platform 18. Additionally, each aperture 52 is dimensioned to releaseably receive a detent 39.

The foot platform 20 further comprises spaced apart generally coplanar bottom walls 54 and 56 which are spaced from the top wall 46 by dimension "e" which is equal to or slightly greater then the height "b" of the control platform 18. In view of this construction, the control platform 18 can be slideably received within the channel defined by the foot platform 20. Additionally, the detents 39 of the control platform 18 will releaseably engage the apertures 52 in the sidewalls 48 and 50 of the foot platform 20 to retain the control platform 18 and foot platform 20 in a selected position. However, the resiliency of the sidewalls 48 and 50 of the foot platform 20 relative to the top wall 46 thereof and/or the resiliency of the detents 39 of the control platform 18 enables the control platform 18 to be forceably moved in sliding relationship to the foot platform 20 to achieve an adjustable mounting therebetween.

Figure 2:
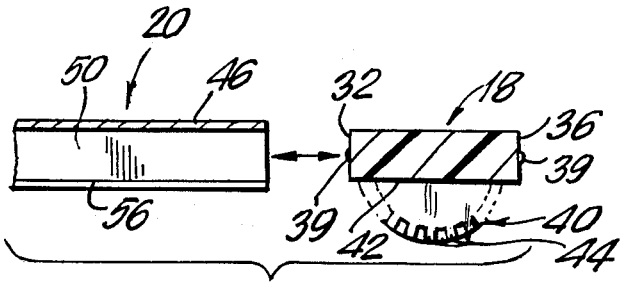
FIG. 2 is an exploded cross-sectional view of the control and foot platforms in a first orientation.
Figure 3:
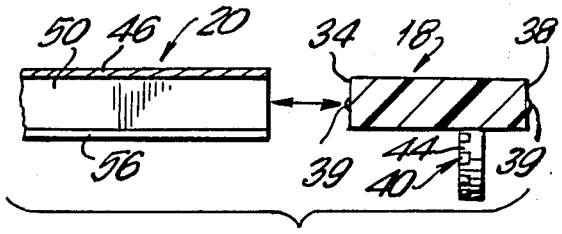
FIG. 3 is an exploded perspective view of the control and foot platforms in a second orientation.
Figure 4:
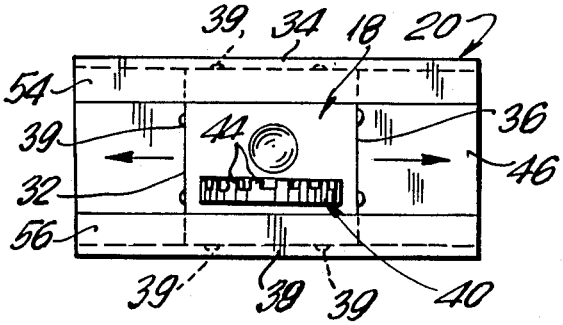
FIG. 4 is a bottom plan view of the assembled foot and control platforms of the subject invention.

As noted above, the top surface of the control platform 18 is substantially square with equal lengths and widths defined by dimension "a". However, the drive gear 40 is rigidly fixed to the control panel 18. The square configuration of the control platform 18 enables the alignment of the drive gear 40 to be placed in either of two orthogonally disposed orientations relative to the longitudinal axis of the foot platform 20. More particularly, as shown in FIGS. 1 and 2, the sidewalls 34 and 38 of the control platform 18 can be placed in sliding relationship to the sidewalls 48 and 50 of the foot platform 20 such that the drive gear 40 lies in a plane substantially parallel to the longitudinal axis of the foot platform 20. However, the control platform 18 can be rotated 90 degrees in its own plane such that the sidewalls 32 and 36 thereof are in sliding engagement with the sidewalls 48 and 50 of the foot platform 20. In this orientation, as depicted in FIG. 3, the plane defined by the drive gear 40 is substantially orthogonal to the longitudinal axis of the foot platform 20. In either orientation, the control platform 18 and the foot platform 20 can be slideably moved relative to one another, as depicted generally in FIG. 4, and can be lockingly but releaseably retained in a selected position by virtue of the engagement of detents 40 with apertures 52.

Figure 5:
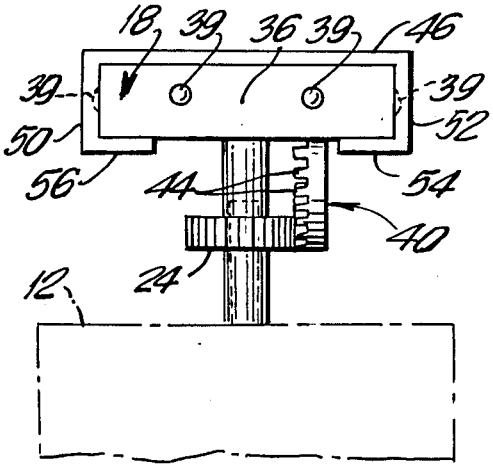
FIG. 5 is a front elevational view of the adjustable control apparatus mounted to a potentiometer of an electronic instrument control.
Figure 6:
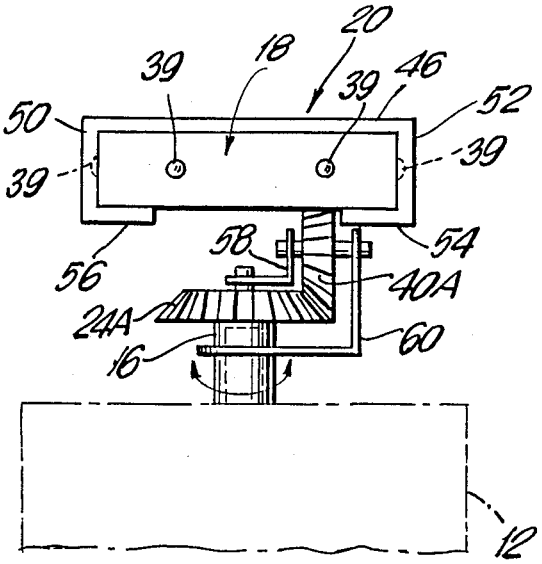
FIG. 6 is a front elevational view similar to FIG. 5 but showing an alternate embodiment.
Figure 7:
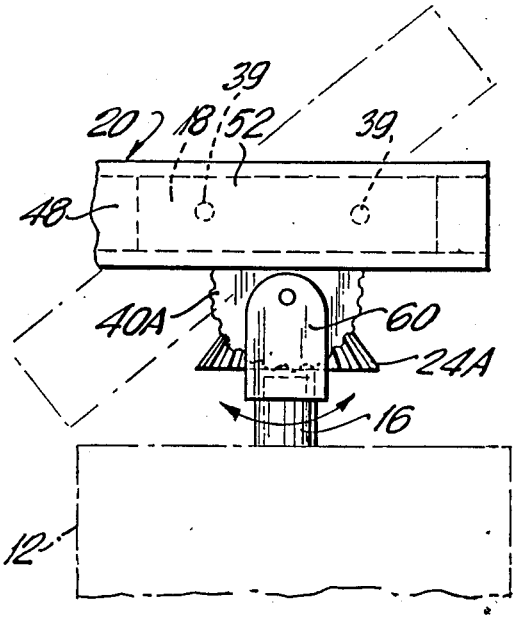
FIG. 7 is a side elevational view of the apparatus shown in FIG. 6.

The control apparatus 10 is assembled as shown in FIG. 5 by telescopingly engaging the geared sheath 16 over a potentiometer post 14 on an electronic control apparatus 12. The control platform 18 is then slideably inserted into the channel defined by the foot platform 20, and these assembled components are then placed over the geared sheath 16 such that the drive gear 40 engages the gear 24. As shown in FIGS. 6 and 7, the control apparatus 10 comprises L-shaped brackets 58 and 60 which are rotatably mounted to the rotational axes of both a beveled response gear 24A and a beveled drive gear 40A. The brackets 54 and 56 are operative to ensure that the rotational axes of the response gear 24A and drive gear 40A remain in a pre-established alignment relative to one another.

By virtue of this above described geared engagement, a foot-actuated pivotal movement of the assembled control platform 18 and foot platform 20 about the longitudinal axis of the drive gear 40 will cause the drive gear 40 to rotate the response gear 24 about its axis, with a corresponding rotational movement of the sheath 16 and the potentiometer shaft 14 mounted therein, as shown in FIGS. 6 and 7.

It will be appreciated that there are various options available in placing the control apparatus 10 on the electronic apparatus 12. In particular, the geared shaft 16 can be slid over the potentiometer shaft 14 at any of the possible rotational alignments of the potentiometer shaft 14. Additionally, the angular orientation of the control platform 18 and the foot platform 20 relative to the geared sheath 16 can be preestablished to define a selected starting or stopping limit for movement of the potentiometer shaft 14. Thus, for example, the orientation of the control platform 18 and the foot platform 20 illustrated in broken lines in FIG. 7 can be preset by the musician to define the maximum volume the musician will accept for a particular work. Movement of the control platform 18 and foot platform 20 beyond this maximum position will be stopped by the engagement of the foot platform 20 with the electronic apparatus 12. Movement of the foot platform 20 with corresponding movement of the control platform 18 toward the angular disposition shown by solid lines will enable the musician to adjust the potentiometer shaft within the limits he or she has established beforehand. These limits, it must be emphasized, all can be adjusted beforehand by selective rotational disposition of the geared sheath 16 relative to the potentiometer shaft 14, and selective rotational disposition of the control platform 18 and foot platform 20 relative to the axis of the geared sheath 16.

Figure 8:
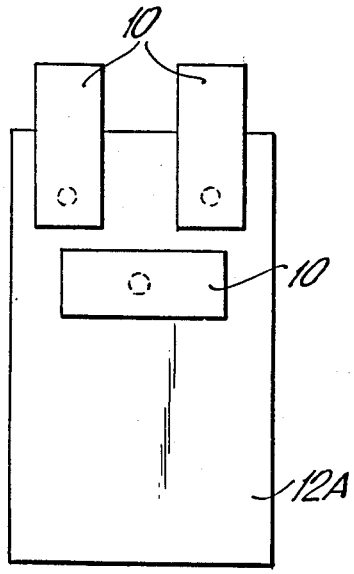
FIG. 8 shows a plurality of adjustable controls mounted to an electronic apparatus.
Figure 9:
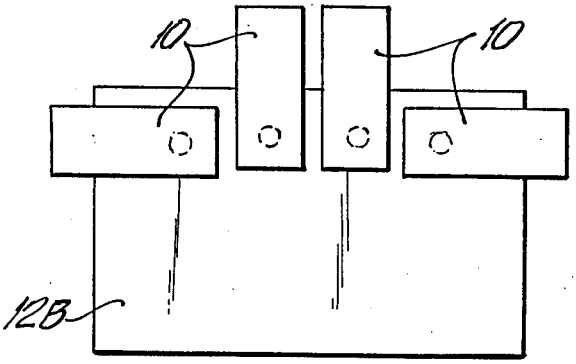
FIG. 9 shows a plurality of adjustable controls mounted to another electronic control apparatus.

The adjustability of the control apparatus 10 is further illustrated in FIGS. 8 and 9. More particularly, the orientation of the geared sheath 16 and the foot platform 20 relative to the electronic apparatus 12A or 12B is selected to enable a plurality of control apparatus 10 to conveniently fit on the electronic equipment 12 and permit ready access to each foot platform 20. Furthermore, the slideable positioning of the foot platform 20 relative to the control platform 18 can be adjusted. Thus, as shown most clearly in FIG. 8, the control platform 18 may be disposed substantially adjacent one end of the foot platform 20, or may be disposed generally centrally along the foot platform 20. Additionally, the angular orientation of the control platform 18 relative to the foot platform 20 can be adjusted with the orientation of potentiometers in mind. In particular, this angular orientation of the control platform relative to the foot platform 20 can be selected to anticipate rotation of the foot platform 20 either about its central axis or about an axis extending orthogonal to the central axis. These relative orientations of the control platform 18 and foot platform 20 are generally made with the physical layout of the potentiometer shafts on the electrical equipment in mind.

In summary, an adjustable control apparatus for a potentiometer shaft is provided. The adjustable control apparatus comprises a geared sheath which is engageable with a potentiometer shaft such that rotation of the geared sheath causes a corresponding rotation of the potentiometer shaft. The geared sheath is provided with a response gear rigidly connected thereto such that rotation of the response gear causes a rotation of the entire geared sheath and a corresponding rotation of the potentiometer to which the geared sheath is mounted. The apparatus further comprises a control platform having a drive gear rigidly connected thereto. The drive gear is engageable with the response gear of the geared sheath. Thus, pivoting movement of the control platform can generate a corresponding rotational movement of the geared sheath through the interaction of the drive and response gears. A foot platform is adjustably and removeably mounted to the control platform. The foot platform is of a size and shape to be engageable by the foot of a musician such that pivoting movement of the foot platform generated by the musician will cause a corresponding pivotal movement of the control platform. Adjustment of the foot platform relative to the control platform is selected by the musician in accordance with the spacial arrangement of potentiometers on the particular electronic equipment.

While the invention has been described with respect to a preferred embodiment, it is apparent that various changes can be made without departing from the scope of the invention as defined by the appended claims.

I claim:

1. An adjustable control apparatus for mounting on the potentiometer shaft of an electronic apparatus, said control apparatus comprising:

potentiometer engagement means for selective releasable engagement with the potentiometer shaft of an electronic apparatus;

a response gear rigidly connected to said potentiometer engagement means, said response gear having a rotational axis;

a drive gear having a rotational axis aligned substantially orthogonal to said response gear, said drive gear engaging said response gear, with rotation of said drive gear about its axis causing a corresponding rotation of said response gear about its axis;

a generally planar control platform integral with said drive gear and parallel to the rotational axis of the drive gear such that pivotal movement of said control platform generates rotational movement of said drive gear; and a foot platform adjustably mounted to said control platform such that the relative positions of said control platform and said foot platform relative to one another is adjustable, whereby pivotal movement of said foot platform causes corresponding pivotal movement of said control platform and associated rotational movement of the drive gear about its axis, and wherein the rotational movement of said drive gear causes corresponding rotational movement of the response gear, the potentiometer engagement means and the potentiometer shaft for affecting rotational adjustments to the potentiometer shaft.

2. A control apparatus as a claim 1 wherein the foot platform and the control platform are in slideable engagement with one another.

3. An adjustable control apparatus for mounting on the potentiometer shaft of an electronic apparatus, said control apparatus comprising:

potentiometer engagement means for selective releasable engagement with the potentiometer shaft for an electronic apparatus;

a response gear rigidly connected to said potentiometer engagement means, said response gear having a rotational axis;

a drive gear having a rotational axis aligned substantially orthogonal to said response gear, said drive gear engaging said response gear, with rotation of said drive gear about is axis causing a corresponding rotation of said response gear about its axis;

a generally planar control platform having equal length and width dimensions rigidly connected to said drive gear and generally parallel to the rotational axis of the drive gear such that pivotal movement of said control platform generates rotational movement of said drive gear; and a foot platform defining an elongated channel having a width equal to the length and width of the control platform and being adjustably engageable around said control platform at any of a plurality of positions therealong such that the relative positions of said control platform and said foot platform relative to one another is adjustable, whereby pivotal movement of said foot platform causes corresponding pivotal movement of said control platform and associated rotational movement of the drive gear about its axis, and wherein the rotational movement of said drive gear causes corresponding rotational movement of the response gear, the potentiometer engagement means and the potentiometer shaft for effecting rotational adjustments to the potentiometer shaft.

4. A control apparatus as in claim 3 wherein said control platform and said drive gear are of integral construction.

5. A control apparatus as in claim 1 wherein said foot platform defines a channel engagement around said control platform.

6. A control apparatus as in claim 5 wherein said control platform is substantially square, and wherein said foot platform is of elongated generally rectangular configuration, said control platform being adjustably engageable at any of a plurality of positions long the elongated foot platform.

7. A control apparatus as in claim 6 wherein the foot platform is engageable with the generally square control platform in each of a plurality of different angular orientations relative to said control platform.

8. A control apparatus as in claim 1 wherein said control platform comprises a plurality of detents, and wherein said foot platform comprises a plurality of apertures engageable with the detents of said control platform for securely but adjustably maintaining said control platform and said foot platform in a selected position relative to one another.

9. A control apparatus as in claim 8 wherein the detents are resilient.

10. A control apparatus as in claim 8 wherein in portions of said foot platform engageable with said control platform are resilient to enable secure but adjustable connection therebetween.

11. A control apparatus as in claim 1 comprising bracket means for retaining the rotational axis of said drive gear and said response gear in a predetermined angular orientation relative to one another.

12. A control apparatus as in claim 11 wherein the rotational axis of said drive gear is substantially orthogonal to the rotational axis of said response gear.

13. An adjustable control apparatus for mounting on the potentiometer shaft of an electronic apparatus, said control apparatus comprising:

potentiometer engagement means for selective releasable engagement with the potentiometer shaft of an electronic apparatus;

a response gear rigidly connected to said potentiometer engagement means, said response gear having a rotational axis;

a drive gear having a rotational axis aligned substantially orthogonal to said response gear, said drive gear engaging said response gear, with rotation of said drive gear about its axis causing a corresponding rotation of said response gear about is axis;

a generally planar control platform rigidly connected to said drive gear and generally parallel to the rotational axis of the drive gear such that pivotal movement of said control platform generates rotational movement of said drive gear, said control platform comprising at least one detent; and a foot platform adjustably mounted to said control platform such that the position of said foot platform relative to said control platform is adjustable, said foot platform comprising a plurality of apertures respectively engageable with the detent of said control platform for adjustably maintaining the control platform and the foot platform in a selected position relative to one another, whereby pivotal movement of said foot platform causes corresponding pivotal movement of said control platform and associated rotational movement of the drive gear about its axis, and wherein the rotational movement of said drive gear causes corresponding rotational movement of the response gear, the potentiometer engagement means and the potentiometer shaft for effecting rotational adjustments to the potentiometer shaft.

* * * * *